US006745545B2

(12) United States Patent
Schneider et al.

(10) Patent No.: US 6,745,545 B2
(45) Date of Patent: Jun. 8, 2004

(54) HORIZONTAL FORM, FILL AND SEAL MACHINE FOR LOOSE FITTING PACKAGES

(75) Inventors: John H. Schneider, Frankfort, IL (US); Stanley Piotrowski, Schiller Park, IL (US); Nigel Knight, Kankakee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/885,211

(22) Filed: Jun. 20, 2001

(65) Prior Publication Data

US 2002/0194816 A1 Dec. 26, 2002

(51) Int. Cl.[7] ..... B65B 61/18; B65B 61/20; B31B 1/90

(52) U.S. Cl. ..... 53/412; 53/133.4; 493/214

(58) Field of Search ..... 53/412, 133.2, 53/133.4, 556; 493/213, 214; 156/66

(56) References Cited

U.S. PATENT DOCUMENTS

| | | | | | |
|---|---|---|---|---|---|
| 2,882,662 | A | * | 4/1959 | Campbell | 53/550 |
| RE30,010 | E | * | 5/1979 | Shanklin | 53/550 |
| 4,715,166 | A | | 12/1987 | Kameda | 53/550 |
| 5,564,259 | A | * | 10/1996 | Stolmeier | 53/133.4 |
| 5,564,261 | A | | 10/1996 | Kiner | 53/439 |
| 5,706,635 | A | * | 1/1998 | Simmons | 53/550 |
| 5,921,067 | A | * | 7/1999 | Fujiwara et al. | 53/550 |
| 5,937,615 | A | * | 8/1999 | Forman | 53/133.4 |
| 6,119,435 | A | | 9/2000 | Fujiwara et al. | 53/389.3 |
| 6,131,369 | A | * | 10/2000 | Ausnit | 53/412 |
| 6,185,907 | B1 | * | 2/2001 | Malin et al. | 53/412 |
| 6,308,498 | B1 | * | 10/2001 | Malin et al. | 53/412 |
| 6,389,780 | B1 | * | 5/2002 | Coomber et al. | 53/412 |
| 6,393,804 | B1 | * | 5/2002 | Ausnit | 53/412 |

FOREIGN PATENT DOCUMENTS

| | | |
|---|---|---|
| AU | 200045067 | 2/2001 |

* cited by examiner

*Primary Examiner*—Anthony D. Stashick
(74) *Attorney, Agent, or Firm*—Pitney Hardin LLP

(57) ABSTRACT

A horizontal form, fill and seal machine has a hollow forming box into which a continuous film is longitudinally fed from a packaging film supply. The forming box has a top, sides and open inlet and outlet ends. A pair of guide bars extend from the outlet end of the forming box adjacent the forming box sides and extending away from the inlet end. The forming box transforms the flat packaging film into a film envelope that extends about the guide bars and has a product-receiving surface that rests on a conveyor between the guide bars. Sealing bars are provided to join the longitudinal edges of the packaging film together and to form seals across the envelope at package length intervals after each deposit of product onto the product-receiving surface. A zipper attaching mechanism applies zipper to the film upstream of the forming box.

25 Claims, 4 Drawing Sheets

HORIZONTAL FORM, FILL AND SEAL MACHINE FOR LOOSE FITTING PACKAGES

BACKGROUND OF THE INVENTION

The present invention relates to reclosable packaging and, in particular, to an apparatus for horizontally forming, filling and sealing such packages to loosely fit about a packaged product.

Horizontal form, fill and seal (HFFS) machines are commonly used for packaging block-shaped products such as chunks of cheese, cheese slices or various products that are contained in a tray such as cookies and crackers. The package is formed of a flat sheet of plastic film onto which the product is deposited. One or both side portions of the sheet are wrapped over the product, the sheet side edges are sealed together and transverse seals are formed to complete the package about the product. A zipper may be provided for the package between the sheet edges or in a fold formed in the film in order to render the package reclosable after it is initially opened through the zipper. U.S. Pat. Nos. 4,589,145; 5,247,781 and 6,138,436 are representative of such prior art HFFS machines.

The packages formed on such machines are generally tightly pulled over the product during the wrapping operation for package aesthetics and in order to maintain constant width for the final packages. That is, if the film is not pulled at least semi-tight over the product, the width of the final packages tends to vary from package to package. Further, unless the film is pulled at least semi-tight the film may wrinkle during the package formation. These may cause consumer acceptance problems as well as difficulties in packing the packaged product. However, for certain applications, it may be desirable not to have the packaging film tight against the product. For example, a loose package permits easier removal of the package contents and facilitates returning product to the package. Also, where the package is to be provided with a fitment such as a spout or a zipper and, particularly with a slider activated zipper, a tight fit between the package and product may place undo stress on the package and interfere with the operation of the zipper. Also, where a tamper evident seal is provided inboard of the zipper, the consumer may find it difficult to rupture the seal when the product is tight against the seal.

SUMMARY OF THE INVENTION

In view of the above, the present invention provides an HFFS machine which forms uniform loosely fitting packages about the products to be packaged therein. The present invention further provides such a machine that may be formed without modification of the major portions of conventional HFFS machines which operates generally in the same manner as conventional HFFS machines.

The above and other objects and advantages are attained in accordance with the present invention by providing a horizontal form, fill and seal machine having a hollow forming box into which a continuous film is longitudinally fed from a packaging film supply. The forming box has a top, sides and open inlet and outlet ends. A pair of guide bars adjacent the forming box sides extend through the forming box beyond the outlet end of the forming box. A slit conveyor is provided extending longitudinally between the guides. The interior of the forming box is contoured to guide the packaging film to flow adjacent the top, down the sides, about the guide bars and onto the conveyor thereby forming a film envelope moving along the conveyor. The front ends of he guide bars may be tapered upwardly to generally follow the contours of the forming box.

The conveyor extends generally horizontally and the forming box is inclined with respect to the conveyor so that product may be fed through the forming box and into the film envelope so that the package formation may be completed about the product. After the envelope clears the free ends of the guide bars, cross seams are formed in the envelope at the leading and lagging ends of the product to complete the package about the product. A zipper may be attached to the film prior to feeding the film into the forming box.

DETAILED DESCRIPTION OF THE PREFERRED EMBODIMENT

Figure 1:
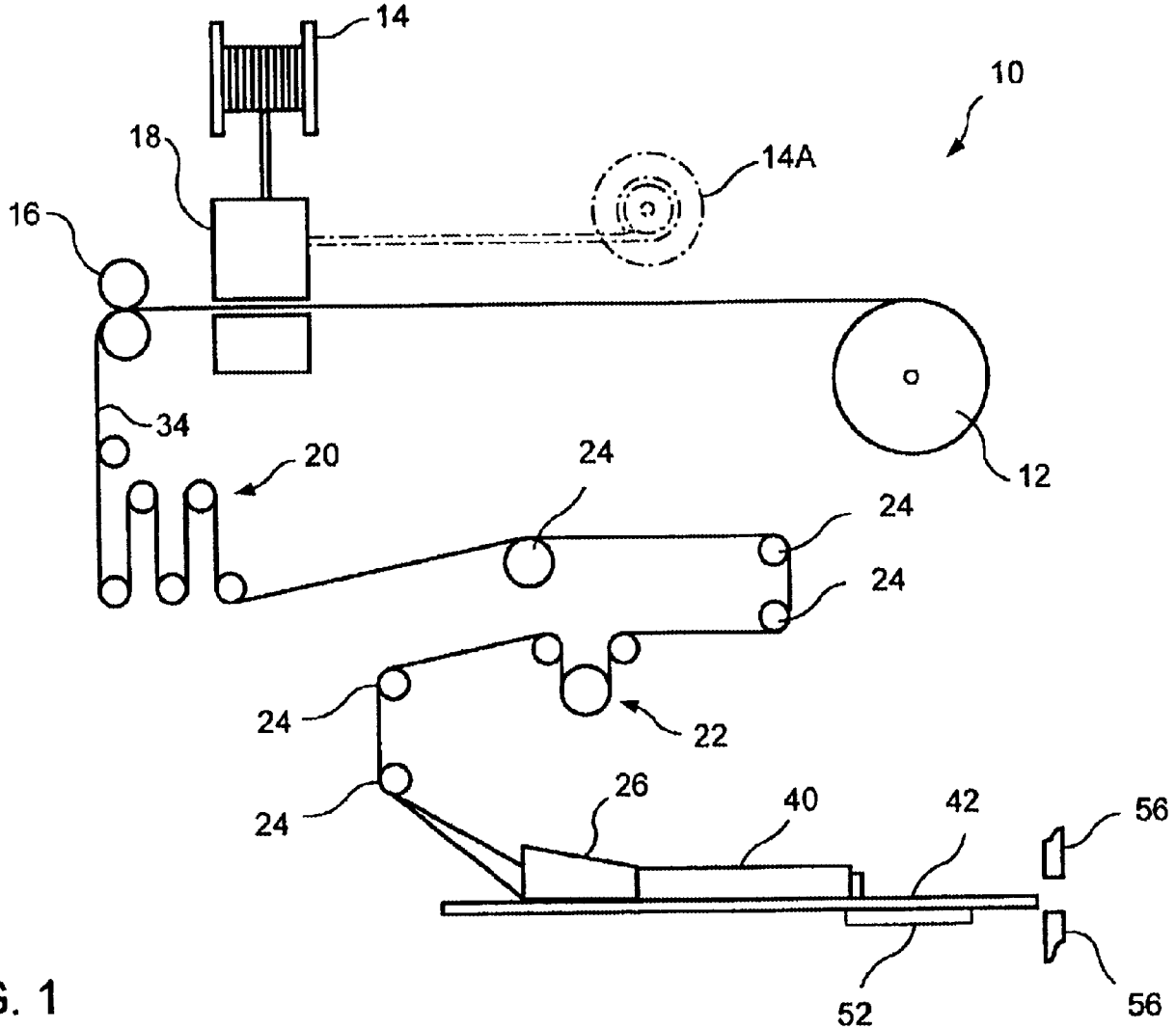
FIG. 1 is a simplified side, elevational schematic view of the horizontal form, fill and seal machine of the present invention.

Reference is now made to the drawings and to FIG. 1 in particular wherein a schematic representation of the form, fill and seal machine 10 of the present invention is depicted as comprising a supply of packaging film 12 and a supply of zipper 14. The film is drawn by drive rollers 16 through a zipper attaching mechanism 18 where discrete sections of zipper are applied transversely across the film at spaced intervals. The zipper may contain a slider or be slider-less. Such zipper attaching mechanisms are commercially available under the trade name TOP ZIP from the AMI/RecPro division of ITW Inc., located in Atlanta Ga. It suffices to say for the present that the zipper applicator 18 attaches a section of zipper that is approximately equal in length to one half the width of the packaging film to a center section of the film leaving margins on both sides of the film web without zipper.

Alternatively the zipper may be applied to the film longitudinally (i.e. in the film running direction rather than transversely across the film) by utilizing a zipper supply 14A as shown in phantom in FIG. 1 and changing the orientation of the seal bars of zipper attaching mechanism 18 accordingly. In this instance it may be desirable to slit the film longitudinally and seal the zipper to the film edges created by the slit.

Whether the zipper is applied transversely or parallel to the film running direction, the handling of the film and attached zipper is substantially the same. The film and attached zipper 34 are fed through a dancer system 20 by a drive 22 through guide rollers 24 to a forming box 26. The guide rollers 24 serve to orient the web so that the zipper is on the under surface of the web as it enters the forming box 26.

Figure 2:
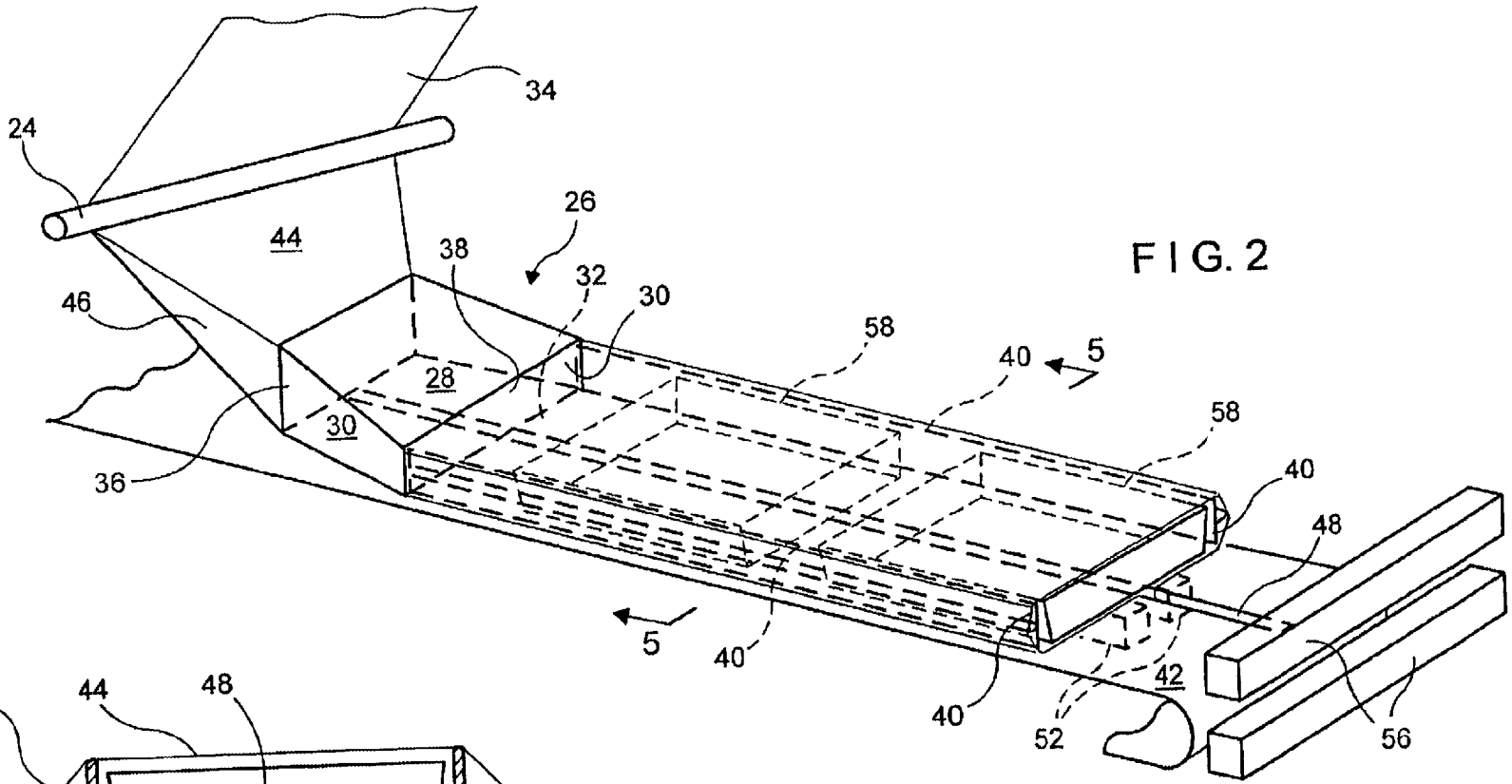
FIG. 2 is a perspective view of the forming box section of the horizontal form, fill and seal machine.

Referring to FIG. 2, it can be seen that the forming box 26 includes a top wall 28, opposed side walls 30 and bottom wall 32. The film with attached zipper 34 is fed into the open inlet end 36 of forming box 26 and exits the open outlet end 38. Guide bars 40 extend from the side walls 30 through the outlet end away from the inlet end. A horizontal conveyor 42 is positioned between the guide bars 40.

In the forming box the film with attached zipper 34 is guided by internal surfaces of the forming box and external surfaces of the guide bars so that a center portion 44 of the web follows the top of the forming box. The marginal side portions 46 of the web are guided about the guide bars 40 that extend into the forming box and onto the conveyor 42 to form a product receiving film surface 54 on the conveyor. The opposed longitudinal edges 50 of the film are fed into a slit 48 formed in the conveyor. A pair of longitudinally extending sealing bars 52 are positioned under the conveyor on opposite sides of the slit. A second pair of seal bars 56 is provided down stream of the downstream end of the conveyor extending transversely to the conveyor. Alternatively the film could be fed about the forming box and the guide bars adjusted accordingly.

In operation a flat packaging film 12 is fed through the zipper applicator 18 where the discrete sections of zipper 14 are applied to the packaging film at spaced intervals. The film 34 with applied zipper is oriented so that the zipper faces downwardly and is fed into the forming box 26. In the forming box the packaging film is guided so that the zipper bearing center portions follows the internal surfaces of the forming box top while side margin portions are trained about the forming bars and onto the conveyor surface with the longitudinal edges of the film passing through the conveyor belt slit. The conveyor belt is generally horizontal and the forming box is inclined with respect to the conveyor so that product 58, gravity fed through the forming box, is deposited onto the product receiving surfaces 54 of the film that sit on the conveyor. As a section of product bearing formed film passes the longitudinal sealing bars 52, the edges of the film are sealed together forming a closed envelope about the product. The envelope is then moved longitudinally beyond the free ends of the guide bars 40 to the conveyor end where the transverse sealing bars 56 are located. As each product bearing section passes through, the seal bars are actuated to seal the top of the envelope to the bottom of the envelope. In the transverse sealing process, the attachment of the zipper 14 is completed and a seal is formed at the zipper end 60 of the package 64. At the same time the end seal 62 for the opposite (non-zipper) end of the next package is formed.

Figure 5:
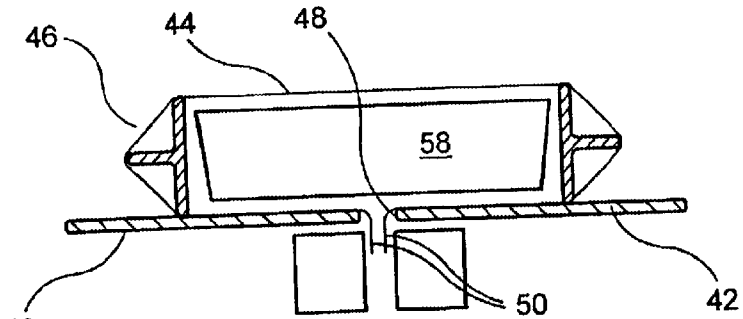
FIG. 5 is a sectional view taken along lines 5—5 of FIG. 4.
Figure 3:
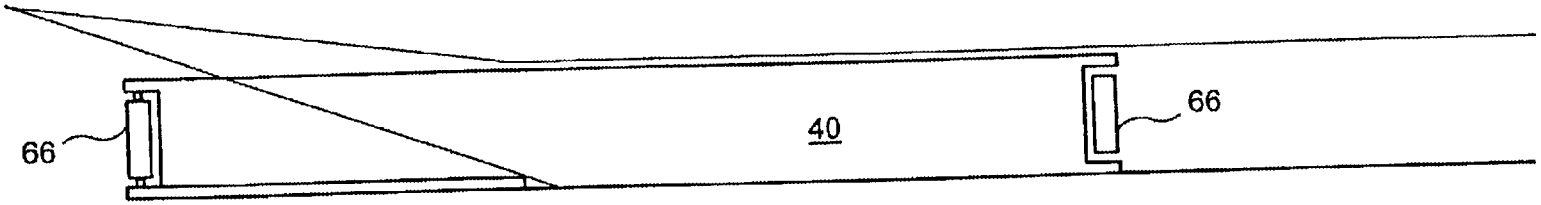
FIG. 3 is a fragmentary side elevational view of the guide bars of the horizontal form, fill and seal machine.
Figure 4:
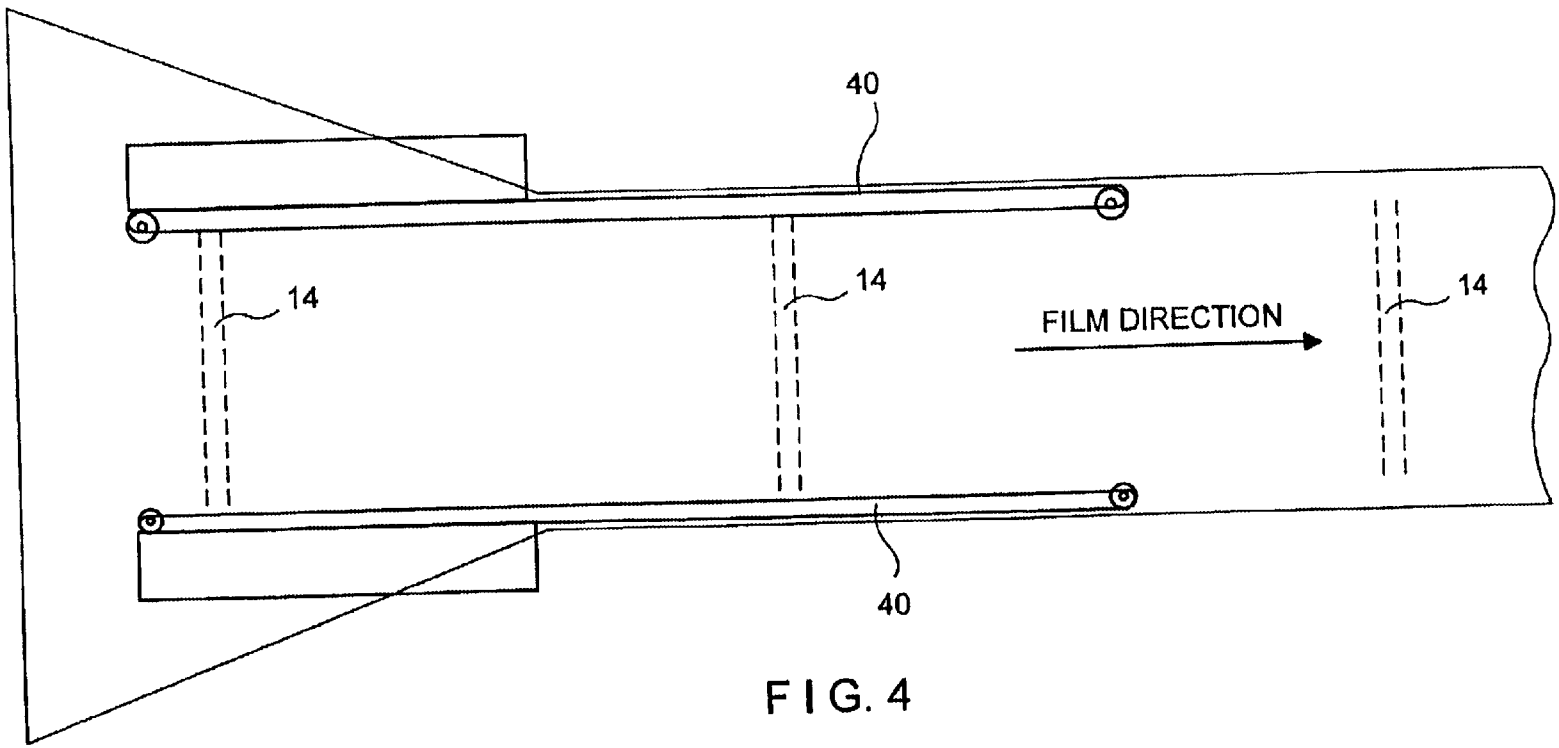
FIG. 4 is top plan view of the packaging film flowing through the forming box section of the horizontal form, fill and seal machine.
Figure 6:
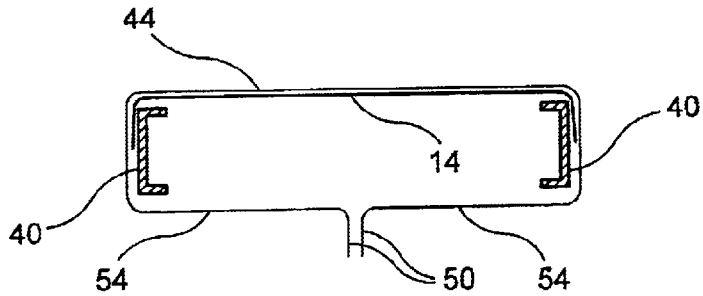
FIGS. 6–9 are views similar to FIG. 5 depicting the folding of the film about alternative guide bars.
Figure 7:
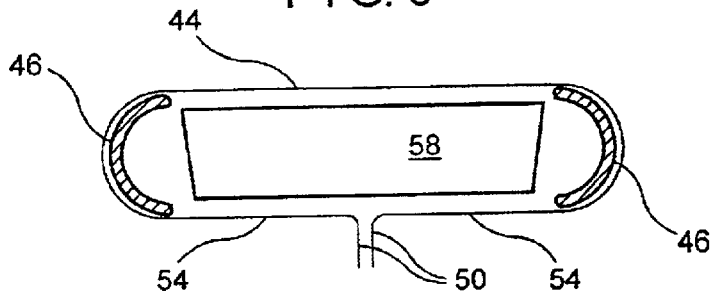
Figure 8:
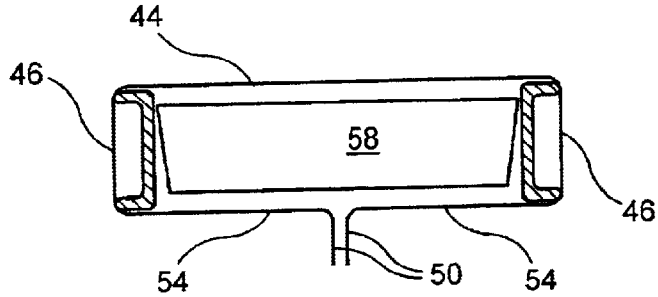
Figure 9:
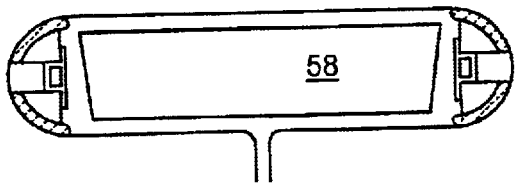
Figure 10:
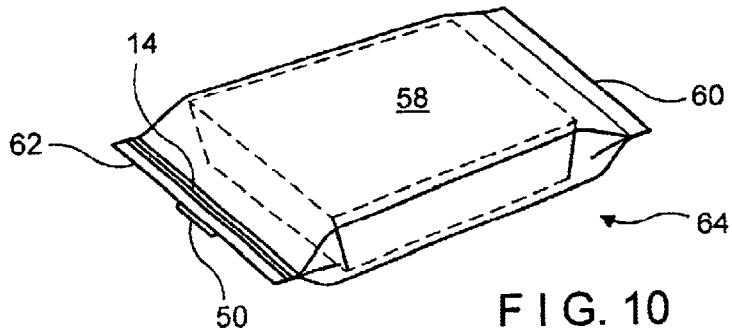
FIG. 10 is a perspective view of a bag made in accordance with the method and on the apparatus of the present invention and filled with product.

Referring to FIG. 3, it can be seen that the guide bars 40 are provided with rollers 66 at the ends thereof. The rollers facilitate the film along the guide bars. To this end, the guide bars may be coated with Teflon or a ceramic to facilitate film movement. Likewise the bars may be grooved or knurled to facilitate the film flow over the bars. In FIG. 5 the guide bars 40 are arcuate. Alternative shapes for the guide bars are depicted in FIGS. 6–9. In each case the height of the package 64 is determined by the height of the guide bars and the width (from side to side of the package) is determined by the thickness of the guide bars.

Thus, in accordance with the above, the aforementioned objectives are effectively attained.

Having thus described the invention, what is claimed is:

1. A packaging machine comprising:

a film drive for longitudinally moving a sheet of packaging film from a film supply to a forming box, said forming box having an open inlet and an open outlet end;

a pair of guide bars located within the forming box and extending in a downstream direction beyond said outlet end; and a conveyor extending from said forming box outlet end between said guide bars, wherein said forming box includes film forming surfaces for guiding a longitudinal center portion of said packaging film along a surface of said forming box and guiding longitudinal side marginal portions of said film about guide bars and onto said conveyor to form a product receiving surface.

2. The packaging machine in accordance with claim 1 wherein said conveyor extends to a sealing station downstream of free ends of said guide bars and said forming box is inclined with respect to said conveyor with said inlet end above said outlet end, whereby product fed through said forming box is deposited onto said product receiving surface.

3. The packaging machine in accordance with claim 1 further comprising:

a longitudinal slit in said conveyor and sealing bars disposed on opposite sides of said slit whereby longitudinal edges of said packaging film marginal portions passing through said slit may be sealed together to form an envelope.

4. The packaging machine in accordance with claim 2 wherein a pair of sealing bars are provided downstream of said conveyor, said seal bars being respectively positioned above and below said film envelope for joining a top portion of said envelope to a bottom portion of said envelope.

5. The packaging machine in accordance with claim 1 further comprising a zipper attachment mechanism disposed in the path of said packaging film between said packaging film supply and said forming box.

6. The packaging machine in accordance with claim 5 wherein said zipper attachment mechanism attaches a strip of zipper to said film transverse to the direction of longitudinal movement of said packaging film.

7. The packaging machine in accordance with claim 5 wherein said zipper attachment mechanism attaches said zipper to said film in the direction of longitudinal movement of said packaging film.

8. The packaging machine in accordance with claim 1 wherein each of said guide bars includes a first roller for contacting said longitudinal side marginal portions of said film, each of said rollers having an axis perpendicular to the longitudinal axis of the conveyor.

9. The packaging machine in accordance with claim 8 wherein said first rollers are disposed at downstream ends of their respective guide bars.

10. The packaging machine in accordance with claim 9 wherein each of said guide bars includes a second roller upstream of said first rollers.

11. The packaging machine in accordance with claim 1 wherein said guide bars are generally semi-circular.

12. The packaging machine in accordance with claim 1 wherein said guide bars include means for adjusting the heights thereof.

13. A packaging machine comprising:

means for forming a sheet of packaging film into an envelope;

means for longitudinally moving a sheet of packaging film from a film supply to said last mentioned means;

a conveyor extending in a downstream direction from said forming means; and a pair of guide bars respectively adjacent opposite sides of said forming means and extending in a downstream direction beyond an outlet end thereof; and means for transversely sealing across said envelope;

wherein said envelope forming means including surfaces for directing portions of said packaging film onto said conveyor to form a product receiving surface and for directing portions of said packaging film adjacent said product receiving surface about said guide bars.

14. A packaging machine comprising:

means for moving a sheet of packaging film longitudinally from a film supply to a forming box, said forming box having an open inlet end, an open outlet end, and a pair of guide bars located within the forming box and extending from said outlet end away from said inlet end; and means for guiding a longitudinal center portion of said packaging film along the interior of said forming box and guiding longitudinal side marginal portions of said film about said guide bars and onto a conveyor to form a product receiving film surface on said conveyor.

15. The packaging machine in accordance with claim 14 wherein said conveyor extends to a sealing station downstream of free ends of said guide bars and said forming box is inclined with respect to said conveyor with said inlet end above said outlet end, whereby product fed through said forming box is deposited onto said product receiving film surface.

16. The packaging machine in accordance with claim 14 further comprising:

a longitudinal slit in said conveyor and sealing bars disposed on opposite sides of said slit whereby longitudinal edges of said packaging film marginal portions passing through said slit may be sealed together to form an envelope.

17. The packaging machine in accordance with claim 15 wherein a pair of sealing bars are provided downstream of said conveyor, said seal bars being respectively positioned above and below said film envelope for joining a top portion of said envelope to a bottom portion of said envelope.

18. The packaging machine in accordance with claim 14 further comprising a zipper attachment mechanism disposed in the path of said packaging film between said packaging film supply and said forming box.

19. The packaging machine in accordance with claim 18 wherein said zipper attachment mechanism attaches a strip of zipper to said film transverse to the direction of longitudinal movement of said packaging film.

20. The packaging machine in accordance with claim 18 wherein said zipper attachment mechanism attaches said zipper to said film in the direction of longitudinal movement of said packaging film.

21. The packaging machine in accordance with claim 14 wherein each of said guide bars includes a first roller for contacting said longitudinal side marginal portions of said film, each of said rollers having an axis perpendicular to the longitudinal axis of the conveyor.

22. The packaging machine in accordance with claim 21 wherein said first rollers are disposed at downstream ends of their respective guide bars.

23. The packaging machine in accordance with claim 22 wherein each of said guide bars includes a second roller upstream of said first rollers.

24. The packaging machine in accordance with claim 14 wherein said guide bars are generally semi-circular.

25. The packaging machine in accordance with claim 24 wherein said guide bars include means for adjusting the heights thereof.

* * * * *